US011163257B2

(12) United States Patent
Sagawa

(10) Patent No.: US 11,163,257 B2
(45) Date of Patent: Nov. 2, 2021

(54) IMAGE FORMING APPARATUS WITH COAXIALLY ROTATABLE COVER MEMBER AND SUB COVER MEMBER

(71) Applicant: Oki Electric Industry Co., Ltd., Tokyo (JP)

(72) Inventor: Yasumasa Sagawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/067,658

(22) Filed: Oct. 10, 2020

(65) Prior Publication Data

US 2021/0109475 A1 Apr. 15, 2021

(30) Foreign Application Priority Data

Oct. 15, 2019 (JP) ..... JP2019-188404

(51) Int. Cl.
*G03G 21/00* (2006.01)
*G03G 15/20* (2006.01)
*G03G 21/16* (2006.01)

(52) U.S. Cl.
CPC ..... *G03G 21/1633* (2013.01); *G03G 21/1685* (2013.01); *G03G 15/201* (2013.01); *G03G 2221/1639* (2013.01); *G03G 2221/1687* (2013.01)

(58) Field of Classification Search
CPC ..... G03G 21/1628; G03G 21/1633; G03G 21/1685; G03G 2221/1639; G03G 2221/1687
USPC ..... 399/122, 125
See application file for complete search history.

(56) References Cited

U.S. PATENT DOCUMENTS 5,353,100 A * 10/1994 Ohtsuka ..... B41J 2/45 399/111
6,292,638 B1 * 9/2001 Nagamine ..... G03G 15/2035 399/122
9,069,316 B2 * 6/2015 Saeki ..... G03G 15/6573
9,152,102 B2 * 10/2015 Yoo ..... G03G 21/1638
10,599,093 B1 * 3/2020 Uehashi ..... G03G 15/6552
(Continued)

FOREIGN PATENT DOCUMENTS

JP 07098550 A * 4/1995
JP 2008-033295 A 2/2008
JP 2015127743 A * 7/2015

*Primary Examiner* — Robert B Beatty
(74) *Attorney, Agent, or Firm* — Muncy, Geissler, Olds & Lowe, P.C.

(57) ABSTRACT

An image forming apparatus includes an apparatus main body; a cover member that is provided rotatable in a rotation direction about a rotation axis with respect to the apparatus main body, having an opening part, a fuser that fuses a toner image formed on each medium of media wherein the fuser is attached to the apparatus main body by being inserted through the opening part and detached from the apparatus main body by being pulled out of the opening part; and a sub cover member that has an surface portion and is attached to the fuser, wherein in a state in which the fuser is attached to the image forming apparatus, the surface portion of the sub cover is arranged within the opening part, the sub cover member moves in the rotation direction in correspondence with the rotation of the cover member.

17 Claims, 14 Drawing Sheets

(56) References Cited

U.S. PATENT DOCUMENTS

2006/0008294 A1* 1/2006 Ito ..... G03G 21/1685
399/122

* cited by examiner

IMAGE FORMING APPARATUS WITH COAXIALLY ROTATABLE COVER MEMBER AND SUB COVER MEMBER

TECHNICAL FIELD

The present invention relates to an image forming apparatus and can be suitably applied to, for example, an electrophotographic image forming apparatus.

BACKGROUND

In an image forming apparatus such as a copying machine, a printer, or a facsimile that forms an image using an electrophotographic method, an image transferred to a medium using a developer is fused on a medium by a fuser (for example, see Patent Document 1). Conventionally, an electrophotographic image forming apparatus has a structure in which a fuser is accommodated inside an apparatus casing. When the fuser is taken out from the apparatus casing due to sheet jamming or the like, a top cover provided on the apparatus casing is opened to expose the fuser to the outside, and then, the fuser is taken out.

RELATED ART

Patent Document(s)

[Patent Doc. 1] JP Laid-Open Patent Application Publication 2008-33295

Subjects to be Solved

As described above, in the conventional image forming apparatus, since the fuser cannot be taken out from the apparatus casing without opening the top cover, there is a problem that workability in taking out the fuser is poor. In order to take out the fuser directly from the apparatus casing via an opening part without opening the top cover, a structure for preventing formation of a gap between the fuser and the opening part is required.

The present invention is accomplished in consideration of the above problem, and is intended to propose an image forming apparatus that can improve the workability in taking out a fuser.

SUMMARY

An image forming apparatus, disclosed in the application, includes an apparatus main body; a cover member that is provided rotatable in a rotation direction about a rotation axis with respect to the apparatus main body, having an opening part, a fuser that fuses a toner image formed on each medium of media wherein the fuser is attached to the apparatus main body by being inserted through the opening part and detached from the apparatus main body by being pulled out of the opening part; and a sub cover member that has an surface portion and is attached to the fuser, wherein in a state in which the fuser is attached to the image forming apparatus, the surface portion of the sub cover is arranged within the opening part, the sub cover member moves in the rotation direction in correspondence with the rotation of the cover member.

In the present invention, the fuser can be directly taken out from the apparatus casing via the opening part of the cover member that rotates/swings the sub cover member.

According to the present invention, the fuser can be directly taken out from the apparatus casing via the opening part of the cover member that rotates/swings the sub cover member, and thus, an image forming apparatus that can improve the workability in taking out the fuser as compared to a conventional technology can be realized.

DETAILED DESCRIPTION OF THE PREFERRED EMBODIMENT(S)

In the following, modes for carrying out the invention (hereinafter referred to as embodiments) are described using the drawings.

1. External Configuration of the Image Forming Apparatus

Figure 1:
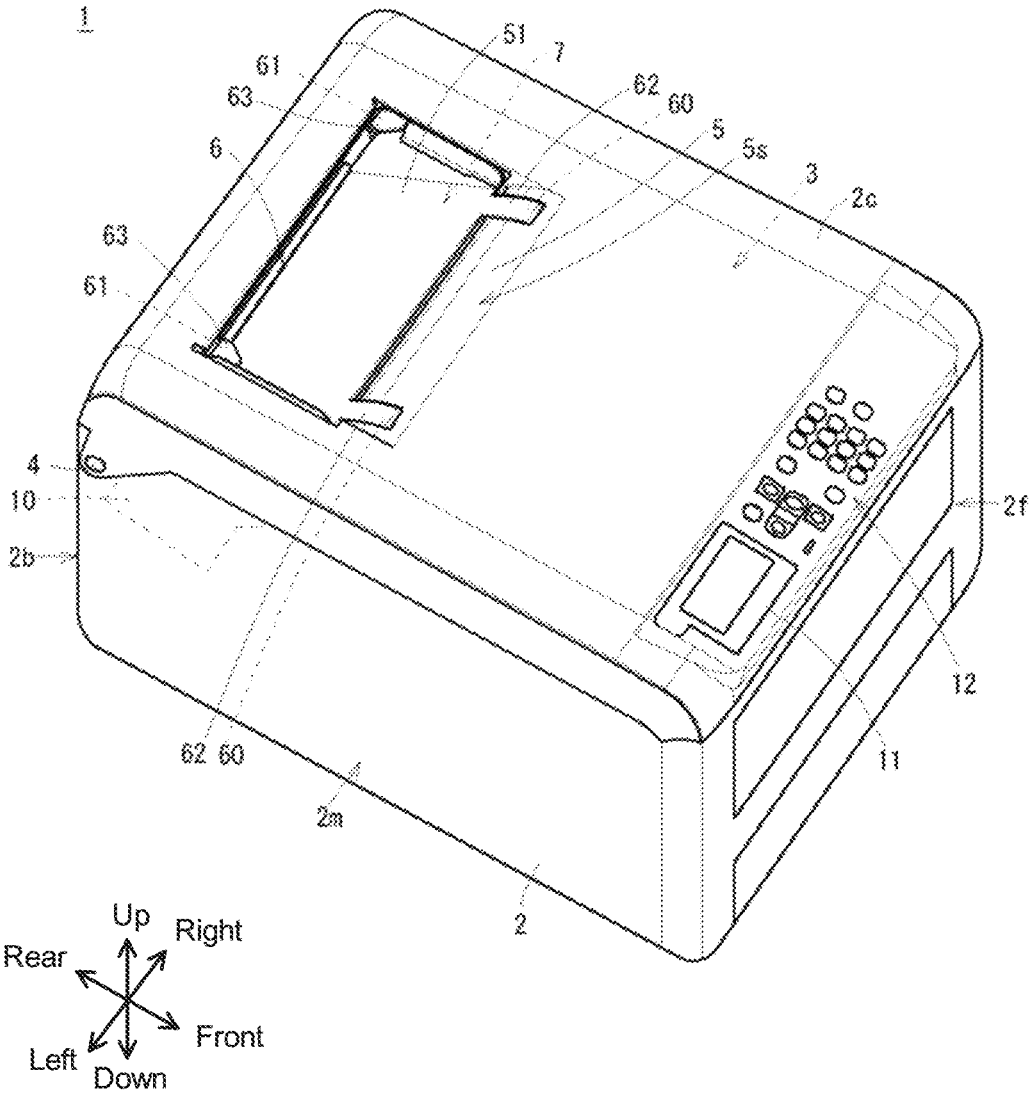
FIG. 1 is a perspective view illustrating an external configuration of an image forming apparatus in a top cover closed state.
Figure 2:
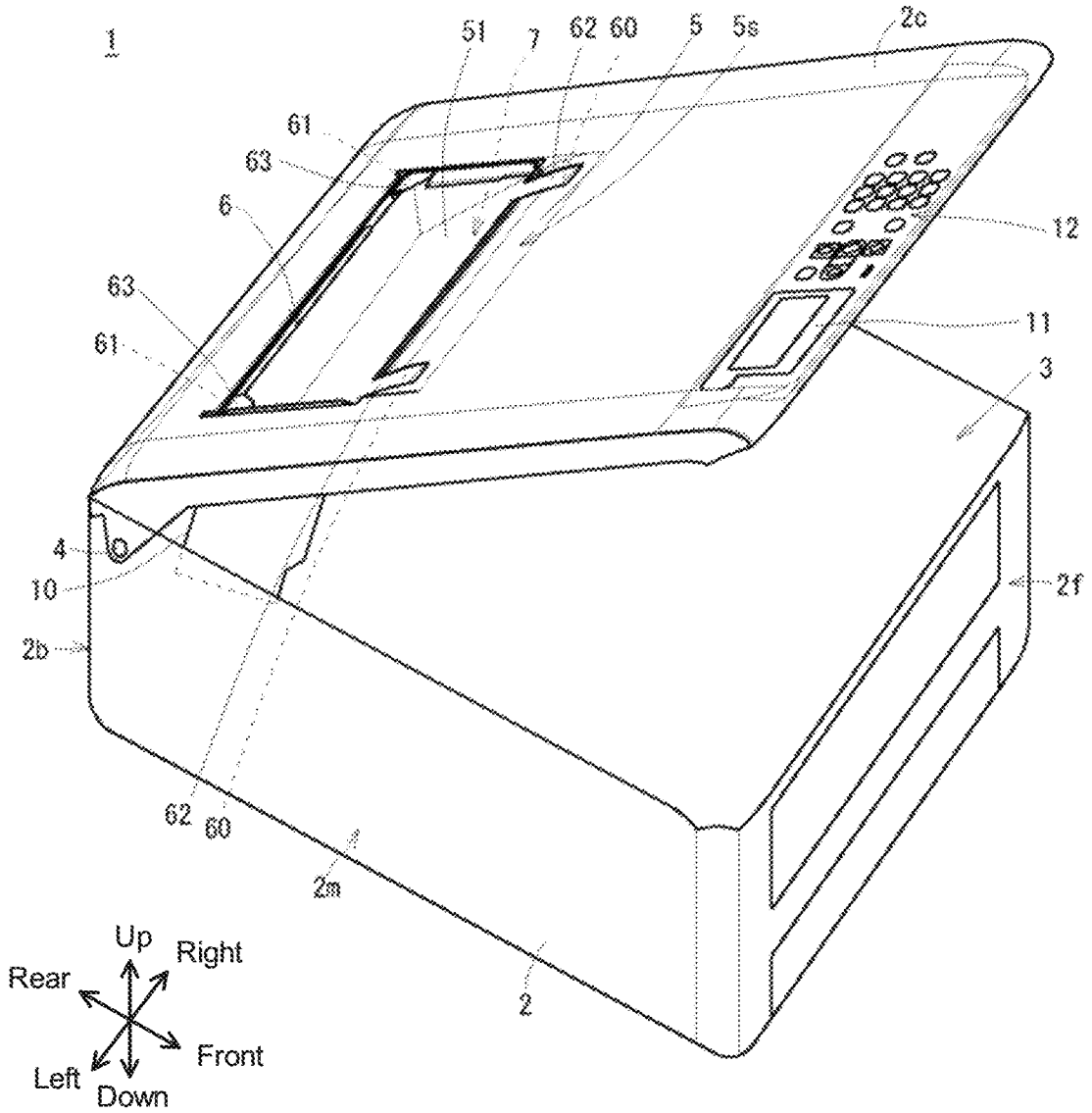
FIG. 2 is a perspective view illustrating the external configuration of the image forming apparatus in a top cover opened state.
Figure 3:
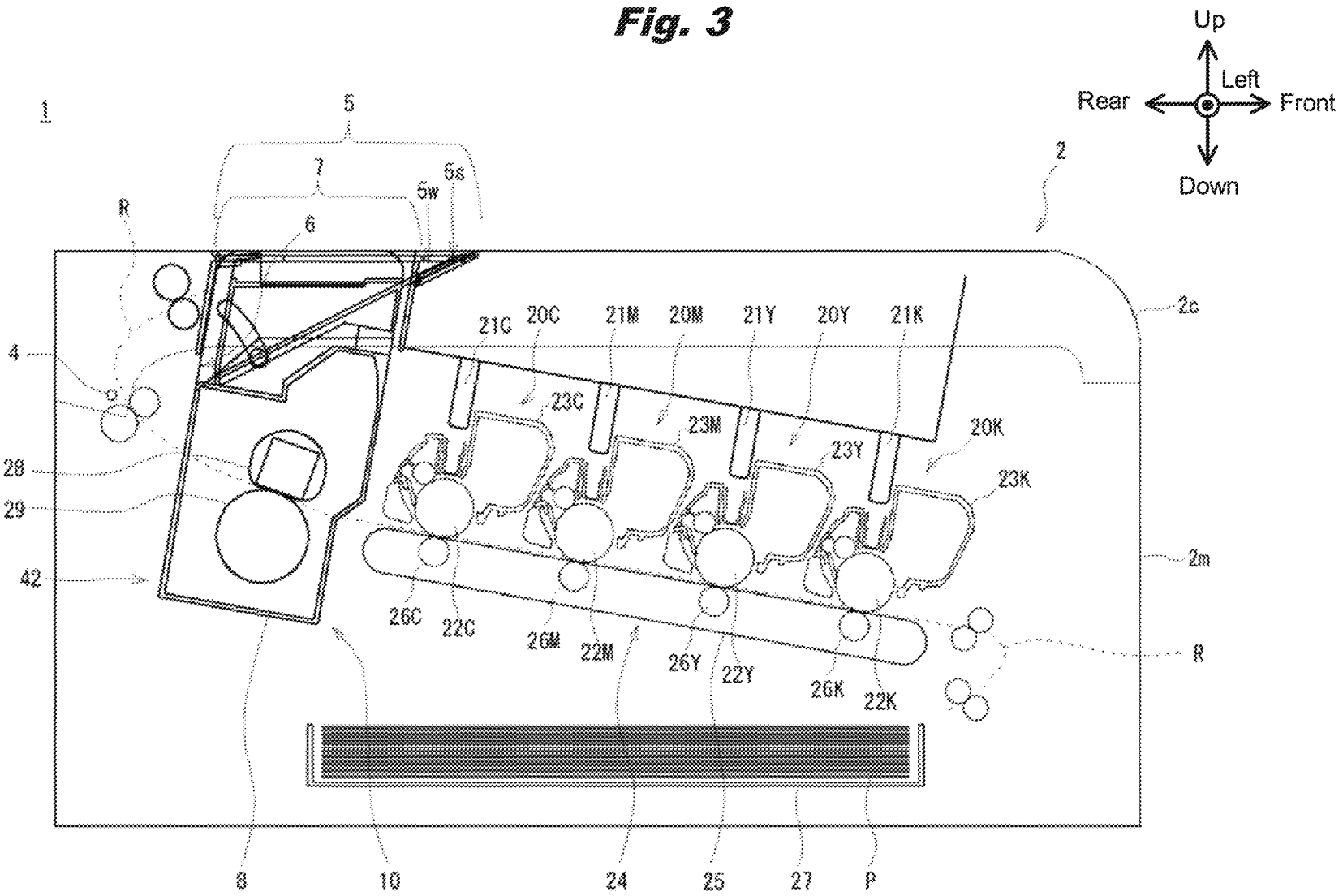
FIG. 3 is a left side view illustrating an internal configuration of the image forming apparatus.

As illustrated in FIGS. 1-3, an image forming apparatus 1 is a printer that forms (that is, prints) an image on a sheet using an electrophotographic method.

First, an external configuration of the image forming apparatus 1 is described. The image forming apparatus 1 has an apparatus casing 2 of a substantially rectangular parallelepiped shape as an external covering. Here, a direction from a front surface 2*f* to a rear surface 2*b* of the apparatus casing 2 is defined as a rearward direction; a direction from the rear surface 2*b* to the front surface 2*f* is defined as a frontward direction; a direction from a lower side to an upper side of the apparatus casing 2 is defined as an upward direction; a direction from the upper side to the lower side of the apparatus casing 2 is defined as a downward direction; a direction from a right side to a left side of the apparatus casing 2 is defined as a leftward direction; and a direction from the left side to the right side of the apparatus casing 2 is defined as a rightward direction.

Figure 4:
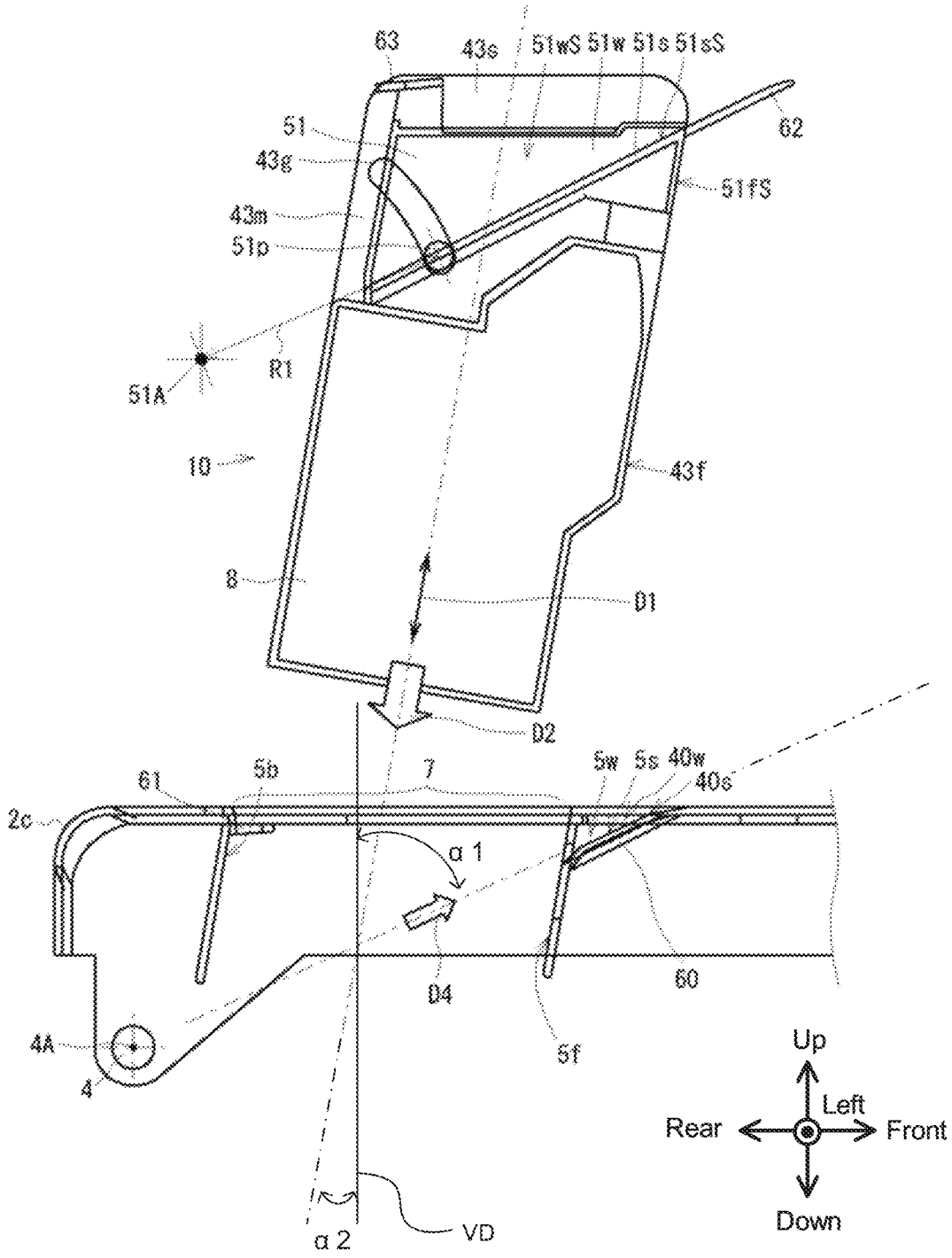
FIG. 4 is a left side view illustrating configurations of a top cover and a fuser unit in a fuser detached state.

The apparatus casing 2 includes a substantially box-shaped casing main body part 2*m* of which an upper surface forms a main body side opening part 3, and a lid-like top cover 2*c* that forms an upper surface of the apparatus casing 2 and covers the main body side opening part 3 of the casing main body part 2*m*. As illustrated in FIG. 2, a top cover rotation shaft 4 that is provided at a rear end of the top cover 2*c* and extends in a left-right direction is rotatably supported by a bearing part (not illustrated in the drawings) provided at an upper end of a rear end part of the casing main body part 2*m*. As a result, as illustrated in FIG. 4, the top cover 2*c* opens when a front side thereof rotates about a top cover rotation center axis 4A which is a center of the top cover rotation shaft 4 in a top cover opening direction away from the casing main body part 2*m*, and closes when front side rotates in a top cover closing direction approaching the casing main body part 2*m*. In this application, the two opposite directions, which are open direction and close direction, are defined as a rotation direction or rotation directions. The rotation of the cover 2*c* means either that the cover is being lifted to open, or that the cover is being shut down to close. When the top cover 2*c* is opened, an inside of the image forming apparatus 1 can be accessed by exposing the inside from the main body side opening part 3 of the casing main body part 2*m*. In the following, as a state of the top cover 2*c*, a state in which the top cover 2*c* is closed to cover the main body side opening part 3 is referred to as a top cover closed state (FIG. 1), and a state in which the top cover 2*c* is opened so that the inside is exposed from the main body side opening part 3 is referred to as a top cover opened state (FIG. 2).

Figure 9:
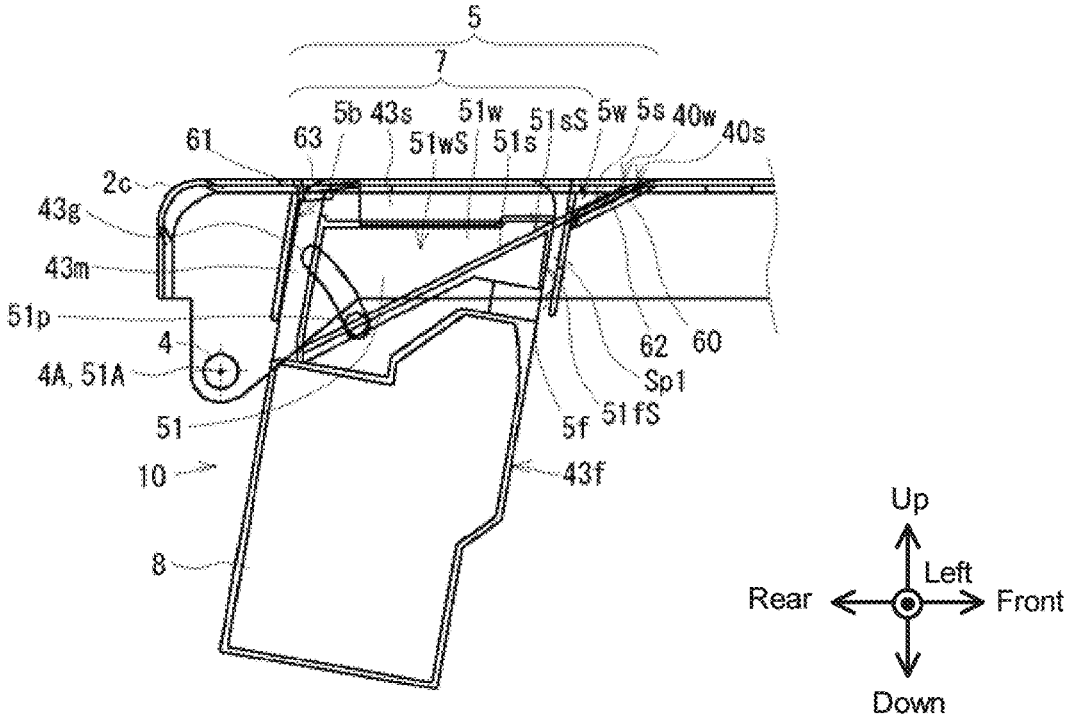
FIG. 9 is a left side view illustrating the configurations of the top cover and the fuser unit in the fuser attached state and the top cover closed state.

Further, as illustrated in FIGS. 1, 3 and 9, a portion of an upper surface of the top cover 2*c* is recessed, and this recessed portion forms a sheet stacker part 5 that stacks (accumulates) sheets. That is, the top cover 2*c* has the sheet stacker part 5 on the upper surface thereof as an outer peripheral part. In the sheet stacker part 5, a stack surface 5*s* as a bottom surface for stacking sheets is an inclined surface that gently rises from a rear end to a front end thereof. The stack surface 5*s* has an angle (a 1), which is ranged from 45 to 80 degrees, with respect to the vertical direction (VD). Further, in the sheet stacker part 5, stack part side wall surfaces 5*w* are respectively formed at left and right two ends of the stack surface 5*s*. In the image forming apparatus 1, a sheet ejected forward from a sheet ejection port 6, which is provided at a lower end part of a top cover insertion port rear side wall surface 5*b* (FIG. 4) of the sheet stacker part 5, is stacked on the stack surface 5*s* of the sheet stacker part 5.

Further, in the top cover 2*c*, a fuser insertion port 7 is provided at a rear part of the sheet stacker part 5. The fuser insertion port 7 is a hole which is long in the left-right direction, and communicatively connects between an upper side and a lower side of the top cover 2*c* at the rear part of the sheet stacker part 5.

In the image forming apparatus 1, from the fuser insertion port 7, a fuser unit 10 is detachably attached to the casing main body part 2*m* along a fuser insertion/removal direction D1 (FIG. 4) in which an upper side of the fuser unit 10 is slightly inclined forward with respect to a vertical direction (VD) which is perpendicular to a bottom surface of the apparatus casing 2. The insertion/removal direction D1 has angle $\alpha$2 ranged from 5 to 50 degrees with respect to the vertical direction VD. In this invention, the vertical direction (VD) may be determined parallel to the gravity, but may be determined perpendicular to the top surface of the apparatus 1. When the fuser unit 10 is attached to the casing main body part 2*m*, an upper surface of a sub cover 51 of the fuser unit 10 is exposed to the outside. The fuser unit 10 can be attached by moving with respect to the top cover 2*c* in a downward fuser insertion direction D2 (FIG. 4) which is one direction of the fuser insertion/removal direction D1 along a linear direction. That is, by being attached to the top cover 2*c* during a print operation, the fuser unit 10 is in a fuser attached state illustrated in FIGS. 1, 3, 6 and 9. On the other hand, when the fuser unit 10 is to be removed from the top cover 2*c* due to sheet jamming or the like, the fuser unit 10 is removed by being lifted from the fuser attached state in an upward fuser removal direction (not illustrated in the drawings) which is the other direction of the fuser insertion/removal direction D1, and the fuser unit 10 is in a fuser detached state illustrated in FIGS. 4 and 5. The fuser unit 10 will be described in detail later. The upper surface of the fuser unit 10 has a shape that closes the fuser insertion port 7 and forms the rear part of the sheet stacker part 5 (that is, the rear parts of the stack surface 5*s* and the left and right stack part side wall surfaces 5*w* of the sheet stacker part 5).

Here, the top cover insertion port rear side wall surface 5*b* of the sheet stacker part 5 is a part of the top cover 2*c*, and is a flat surface that extends from a rear end part of the fuser insertion port 7 along the fuser insertion direction D2 and faces forward. Further, a top cover insertion port front side wall surface 5*f* is a part of the top cover 2*c*, and is a flat surface that extends from a front end part of the fuser insertion port 7 along the fuser insertion direction D2 and faces rearward so as to oppose the top cover insertion port rear side wall surface 5*b*. That is, i the sheet stacker part 5, the stack surface 5*s* and the stack part side wall surfaces 5*w* are formed by the top cover 2*c* and the fuser unit 10, and the top cover insertion port rear side wall surface 5*b* is formed by the top cover 2*c*. The stack surface 5*s* extends from the sheet ejection port 6 along a sheet ejection direction D4 (or medium ejection direction) which is a direction in which a sheet is ejected.

Figure 16:
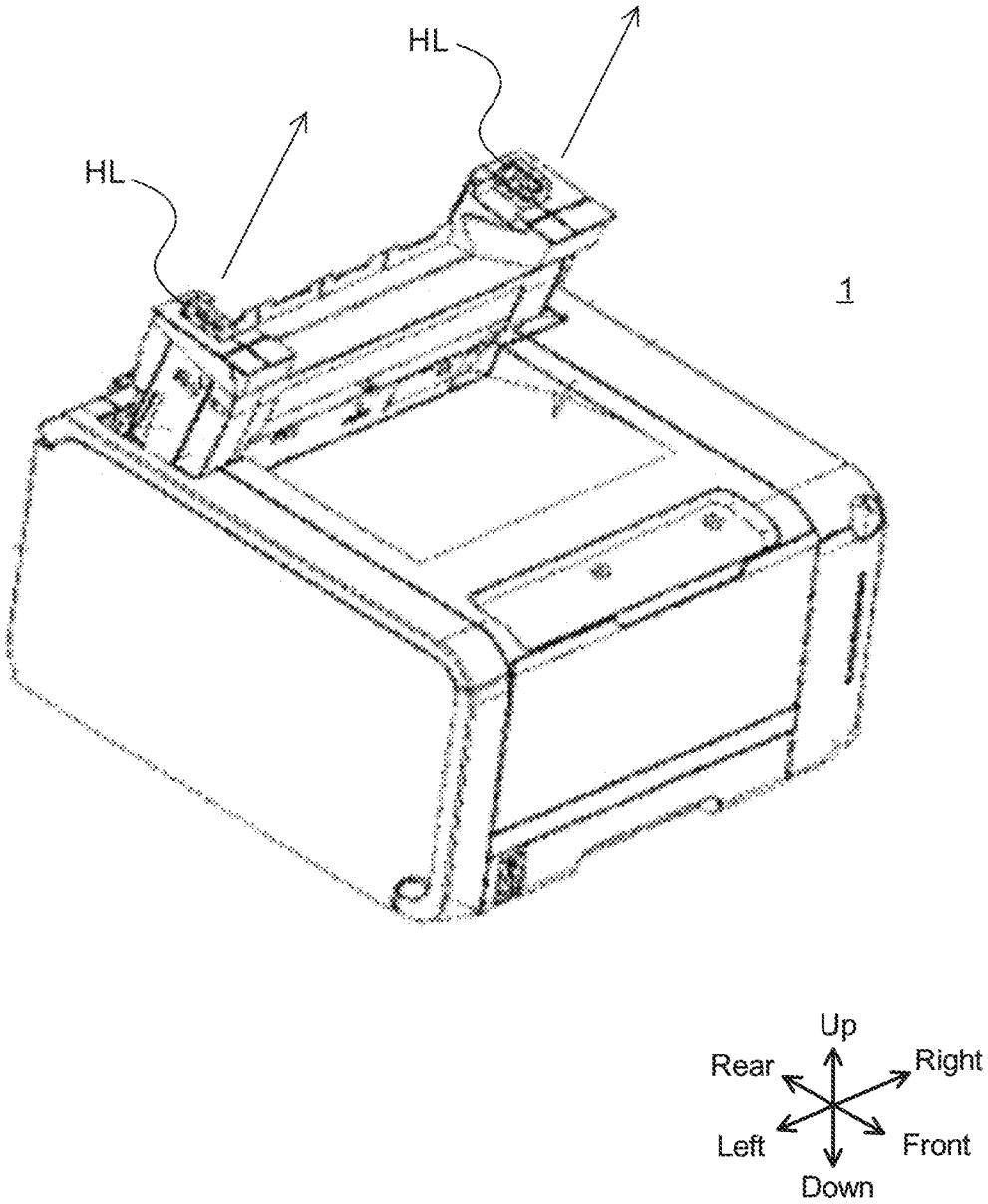
FIG. 16 is a perspective view illustrating a fuser unit in which handles are pulled out.

Further, on the upper surface of the fuser unit 10, a pair of handles HL are respectively provided on left and right two outer side portions of the sheet stacker part 5. The handles are shown in FIG. 16. With the top cover 2*c* of the image forming apparatus 1 in the top cover closed state, by grasping the handles exposed from the fuser insertion port 7 of the top cover 2*c* and pulling the handles upward (in the fuser removal direction), the fuser unit 10 attached to the casing main body part 2*m* can be taken out from the casing main body part 2*m* via the fuser insertion port 7 of the top cover 2*c*. The pulling direction of handles HL is shown with arrows in FIG. 16.

Further, on a front end of the top cover 2*c*, a display panel 11, which allows touch operations to be performed and displays various types of information, and operation buttons 12 or the like are provided. Further, although not illustrated in the drawings, a handle or the like that can be used when opening or closing the top cover 2*c* is provided at a predetermined place on the top cover 2*c*.

2. Internal Configuration of the Image Forming Apparatus

Next, an internal structure of the image forming apparatus 1 is described. As illustrated in FIG. 3, inside the apparatus casing 2, parts are arranged along a carrying path R along which a sheet P is carried. That is, inside the apparatus casing 2, substantially at a center in an up-down direction, four image forming units 20 (image forming units 20K, 20Y, 20M and 20C) respectively corresponding to colors of multiple developers (for example, toners of four colors including black (K), yellow (Y), magenta (M) and cyan (C)) handled in the image forming apparatus 1 are arranged in a front-rear direction along the carrying path R. In the following, the left-right direction which is orthogonal to a carrying direction of the sheet P and to a thickness direction normal to a surface of the sheet P is also referred to as a carrying width direction.

The image forming units 20 (image forming units 20K, 20Y, 20M and 20C) respectively have LED heads 21 (LED heads 21K, 21Y, 21M and 21C), photosensitive drums 22 (photosensitive drums 22K, 22Y, 22M and 22C), and toner containers 23 (toner containers 23K, 23Y, 23M and 23C). The image forming units 20 are each a hardware device in which the LED head 21 emits light to expose a surface of the photosensitive drum 22 to form an electrostatic latent image on the surface of the photosensitive drum 22, and then, a toner supplied from the toner container 23 is attached to the electrostatic latent image to form a toner image on the surface of the photosensitive drum 22.

Further, inside the apparatus casing 2, a transfer unit 24 is provided below the four image forming units 20. The transfer unit 24 includes an annular carrying belt 25 that is provided freely movable in the front-rear direction along the carrying path R, and transfer rollers 26 (transfer rollers 26K, 26Y, 26M and 26C) that are respectively arranged opposing lower sides of the photosensitive drums 22 (photosensitive drums 22K, 22Y, 22M and 22C) with the carrying belt 25 sandwiched therebetween.

The transfer rollers 26 are each a member that, when the sheet P passes between the photosensitive drum 22 and the carrying belt 25, transfers the toner image of the corresponding color formed on the surface of the photosensitive drum 22 to the sheet P by charging the sheet P to an opposite polarity with respect to the toner.

Further, inside the apparatus casing 2, a sheet tray 27 that accommodates the sheet P is provided below the transfer unit 24 (that is, at a lower part in the apparatus casing 2). Further, inside the apparatus casing 2, a carrying roller pair and the like for carrying the sheet P are provided on the carrying path R between the sheet tray 27 and the transfer unit 24.

Further, inside the apparatus casing 2, the fuser unit 10 is provided on a sheet carrying direction downstream side (that is, a rear side) of the transfer unit 24. A fuser 8 of the fuser unit 10 includes a heating roller 28 and a backup roller 29 which is arranged opposing a lower side of the heating roller 28 with the carrying path R sandwiched therebetween. The toner image transferred to the sheet P by the transfer unit 24 is fused onto the sheet P by being heated and pressed by the heating roller 28 and the backup roller 29. Further, inside the apparatus casing 2, an ejection roller pair and the like for ejecting the sheet P from the sheet ejection port 6 to the sheet stacker part 5 are provided on the carrying path R between the fuser unit 10 and the sheet ejection port 6.

3. Configurations of the Top Cover, the Fuser Unit, and their Peripheral Parts Next, configurations of the top cover 2*c*, the fuser unit 10, and their peripheral parts are described in more detail. Here, of the configurations of the top cover 2*c*, the fuser unit 10 and their peripheral parts, only configurations of portions related to opening and closing of the top cover 2*c* and attachment and detachment of the fuser unit 10 are described.

4. Configuration of the Top Cover

Figure 10:
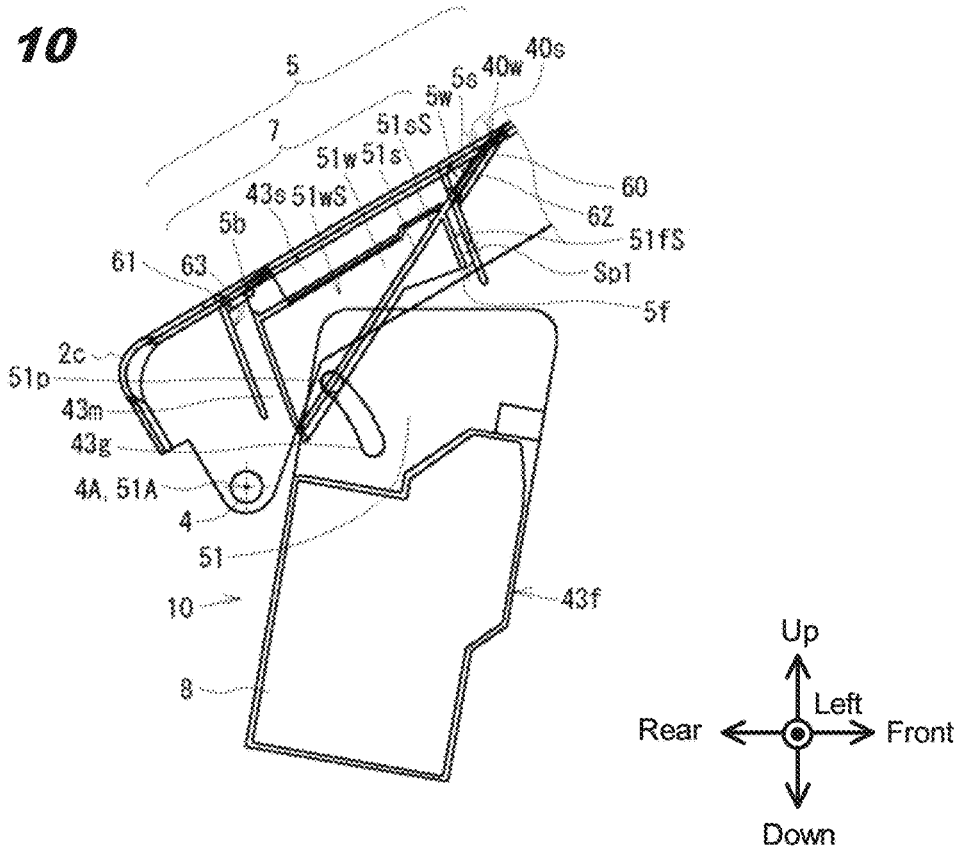
FIG. 10 is a left side view illustrating the configurations of the top cover and the fuser unit in the fuser attached state and the top cover opened state.

As illustrated in FIGS. 4, 9 and 10, the top cover rotation shaft 4 provided at the rear end of the top cover 2*c* is rotatably supported by the bearing part (not illustrated in the drawings) provided at the upper end of the rear end part of the casing main body part 2*m*. Specifically, the top cover rotation shaft 4 is positioned on a rear side of the top cover insertion port rear side wall surface 5*b* of the sheet stacker part 5. The top cover 2*c* opens and closes by rotating around the top cover rotation shaft 4.

Further, the sheet stacker part 5 is provided on the upper surface of the top cover 2*c*, and the fuser insertion port 7 is provided at the rear part of the sheet stacker part 5. The fuser insertion port 7 is about the same in size as the upper surface of the fuser unit 10, and is a hole that opens the rear part of the sheet stacker part 5 and left and right two outer side portions thereof. Of the entire top cover 2*c*, a portion forming a front part of the stack surface 5*s* of the sheet stacker part 5 is referred to as a top cover stack surface formation part 40*s* as a cover stack surface, and portions respectively forming front parts of the left and right stack part side wall surfaces 5*w* of the sheet stacker part 5 are referred to as top cover side wall surface formation parts 40*w*. That is, the fuser insertion port 7 is provided between the top cover insertion port rear side wall surface 5*b* of the sheet stacker part 5 and those top cover stack surface formation part 40*s* and top cover side wall surface formation parts 40*w*.

Two top cover front side seats 60 (FIG. 5) are respectively formed on slightly inner sides of left and right two ends of the rear end part of the top cover stack surface formation part 40*s* at a predetermined interval in the left-right direction. The top cover front side seats 60 each have a planar shape that is recessed downward relative to the top cover stack surface formation part 40*s*, and each have a slightly larger rectangular shape in a plan view than each of sub cover front side arms 62 (to be described later).

Further, two top cover rear side seats 61 (FIG. 5) are respectively formed at left and right two end parts of an upper end part of the top cover insertion port rear side wall surface 5*b* at a larger interval in the left-right direction than the top cover front side seats 60. The top cover rear side seats 61 are each a plate-like member protruding forward from the top cover insertion port rear side wall surface 5*b*, and each have a flat upper surface.

In the casing main body part 2*m*, a fuser accommodating part 42 for detachably accommodating the fuser unit 10 is provided below the fuser insertion port 7 of the top cover 2*c* in the top cover closed state.

5. Configuration of the Fuser Unit

As illustrated in FIGS. 7, 8, 11 and 12, the fuser unit 10 includes the fuser 8 and the sub cover 51.

6. Configuration of the Fuser

The fuser 8 has as an external covering a substantially rectangular parallelepiped fuser casing 43 which is long in the left-right direction. The fuser casing 43 is accommodated in the fuser accommodating part 42 of the casing main body part 2*m* in a state in which an upper surface thereof is exposed from the fuser insertion port 7 to the outside. The fuser accommodating part 42 accommodates the fuser casing 43 in a state in which the fuser casing 43 is inclined forward, and the fuser casing 43 can be taken out by pulling the fuser casing 43 obliquely forward and upward (in the fuser removal direction). Further, the sub cover 51 is attached to an upper surface side as an exposed portion of the fuser casing 43, and the sub cover 51 forms the rear part of the sheet stacker part 5 (that is, the rear parts of the stack surface 5*s* and the left and right stack part side wall surfaces 5*w*).

The fuser casing 43 is covered with a fuser cover 43*m*. The fuser cover 43*m* has fuser cover side plates 43*s*. The fuser cover side plates 43*s* respectively form left and right two end parts of the fuser cover 43*m*, each have the same width as the fuser unit 10 in the front-rear direction, and each have a plate shape that extends long in the vertical direction (or the up-down direction). Further, a fuser covers front side wall surface 43*f* (FIG. 4) is formed at a front end part of the fuser cover 43*m*. The fuser cover front side wall surface 43*f* has a planar shape, and, in the fuser attached state (FIG. 9), is arranged on the same plane as a sub cover front side wall surface 51*f*S of the sub cover 51. Here, of the entire fuser cover 43*m*, an upper surface positioned on a lower side of a sub cover stack surface formation part 51*s* of the sub cover 51 is referred to as a fuser cover upper surface 50*s*. Further, on the fuser cover 43*m*, handles (not illustrated in the drawings) are respectively provided on left and right two outer side portions of the sheet stacker part 5.

Sub cover guide grooves 43*g*, which are each an arc-shaped long hole, are respectively drilled in upper side rear parts of the fuser cover side plates 43*s*. The sub cover guide grooves 43*g* as regulation parts each have an arc shape of which a radius is a cover guide groove radius R1 and which is centered on a sub cover rotation center axis 51A which is positioned on the same axis as the top cover rotation center axis 4A of the top cover 2*c*. The sub cover guide grooves 43*g* are each formed over a rotation angle range of about 30 degrees. The sub cover guide grooves 43*g* each have a groove width that is slightly larger than an outer diameter of each of sub cover posts 51*p* (to be described later) of the sub cover 51, and respectively allow the sub cover posts 51*p* to slide therein in a state in which the sub cover posts 51*p* are respectively inserted into the sub cover guide grooves 43*g*. Therefore, while the sub cover posts 51*p* are respectively slid in the sub cover guide grooves 43*g* of the fuser cover 43*m*, the sub cover 51 is rotated about the sub cover rotation center axis 51A which is a common rotation axis as the top cover rotation center axis 4A.

Further, in the image forming apparatus 1, in opening and closing the top cover 2*c*, in order to prevent interference between the top cover insertion port front side wall surface 5*f* of the top cover 2*c* and the fuser casing 43, a gap Sp1 (FIG. 9) is provided between the top cover insertion port front side wall surface 5*f* of the top cover 2*c* and the fuser casing 43 of the fuser unit 10 accommodated in the fuser accommodating part 42 in the top cover closed state.

However, when the gap Sp1 between the top cover insertion port front side wall surface 5*f* of the top cover 2*c* and the fuser cover front side wall surface 43*f* of the fuser cover 43*m* is open, there is a possibility that a sheet P ejected to the sheet stacker part 5 enters into the inside of the apparatus casing 2 from the gap Sp1, or a foreign body enters into the inside of the apparatus casing 2 from the gap Sp1. Therefore, in addition to the fuser cover 43*m*, the sub cover 51 that covers the gap Sp1 is attached to the upper surface of the fuser casing 43.

7. Configuration of the Sub Cover

The sub cover 51 is attached to the fuser cover 43*m* so as to cover an upper part of the fuser cover 43*m*. That is, the upper surface of the fuser casing 43 has a double-layered structure including the fuser cover 43*m* and the sub cover 51, and the sub cover 51 forms the rear part of the sheet stacker part 5. Here, of the entire sub cover 51, a portion forming a rear part of the stack surface 5*s* of sheet stacker part 5 is referred to as a sub cover stack surface formation part 51*s*, and portions respectively forming the stack part side wall surfaces 5*w* are referred to as sub cover side wall surface formation parts 51*w*. The sub cover stack surface formation part 51*s* and the sub cover side wall surface formation parts 51*w* of the sub cover 51 form surfaces on extension lines of the top cover stack surface formation part 40*s* and the top cover side wall surface formation parts 40*w* of the top cover 2*c*, and the sheet stacker part 5 is formed by the sub cover stack surface formation part 51*s* and the sub cover side wall surface formation parts 51*w* of the sub cover 51 and the top cover stack surface formation part 40*s* and the top cover side wall surface formation parts 40*w* of the top cover 2*c*.

The sub cover stack surface formation part 51*s* is a flat plate member that inclines forward and upward with respect to a horizontal direction, and, on an upper surface thereof, a sub cover stack surface 51*s*S as a planar sub cover stack surface that occupies most of a rear side of the stack surface 5*s* of the sheet stacker part 5 is formed. The sub cover stack surface formation part 51*s* slightly overlaps an upper side of the rear end part of the top cover stack surface formation part 40*s* of the top cover 2*c*.

A sub cover front side wall 51*f* is a flat plate member that extends downward from front end parts of the sub cover side wall surface formation parts 51*w* and is arranged in parallel to the fuser cover front side wall surface 43*f* of the fuser cover 43*m*, and on a front surface thereof, the sub cover front side wall surface 51*f*S is formed. The sub cover front side wall surface 51*f*S has a planar shape, and, in the fuser attached state, faces the top cover insertion port front side wall surface 5*f* (FIG. 9) of the top cover 2*c* in the front-rear direction. Further, in the fuser attached state, a slight gap Sp1 is formed between the top cover insertion port front side wall surface 5*f* of the top cover 2*c* and the sub cover front side wall surface 51*f*S of the sub cover 51. Further, in the fuser attached state, the sub cover front side wall surface 51*f*S is arranged on the same plane parallel to the fuser cover front side wall surface 43*f* of the fuser cover 43*m*.

The sub cover side wall surface formation parts 51*w* are flat plate members that respectively extend upward from left and right two end parts of the sub cover stack surface formation part 51*s* and arranged in parallel to the left and right side plates of the fuser cover 43*m*, and, on left and right inner surfaces thereof, sub cover side wall surfaces 51*w*S are respectively formed. The sub cover side wall surfaces 51*w*S each have a planar shape, and respectively form left and right two outer side surfaces of a rear portion of the sheet stacker part 5.

From slightly inner sides of left and right two ends of a front end part of the sub cover stack surface formation part 51*s*, at an interval equal to that of the top cover front side seats 60 (FIG. 5) in the left-right direction, the sub cover front side arms 62 as two second engaging parts protrude forward in the sheet carrying direction to a front side of the fuser cover 43*m*. The sub cover front side arms 62 each have a rectangular plate shape similar to the top cover front side seats 60 (FIG. 5), and an up-down direction thickness of the sub cover front side arms 62 from a front end part to a rear end part is the same as an up-down direction depth of the top cover front side seats 60. In the fuser attached state (FIGS. 1, 3, 6 and 9), by fitting the sub cover front side arms 62 in the recesses of the top cover front side seats 60 in a manner that the lower surfaces of the sub cover front side arms 62 are in contact with the upper surfaces of the top cover front side seats 60 positioned on a front side of the sub cover stack surface formation part 51*s*, that is, in a manner that the sub cover front side arms 62 are placed on the top cover front side seats 60, the sub cover front side arm upper surfaces 62S, which are upper surfaces of the sub cover front side arms 62, and the top cover stack surface formation part 40*s* overlap and are smoothly connected.

The sub cover 51 covers the gap Sp1 from above by arranging the sub cover front side arms 62 at a carrying width direction interval larger than a carrying width direction length of the sheet and by overlapping the rear end part of the top cover stack surface formation part 40*s* of the top cover 2*c* with the sub cover front side arms 62. Therefore, the stack surface 5*s* of the sheet stacker part 5 is formed by the top cover stack surface formation part 40*s* of the top cover 2*c*, the sub cover stack surface formation part 51*s* of the sub cover 51, and the sub cover front side arm upper surfaces 62S of the sub cover front side arms 62 of the sub cover 51 so that there is no gap. By doing so, in the image forming apparatus 1, in the state in which the upper surface of the fuser unit 10 is exposed from the fuser insertion port 7 of the top cover 2*c*, the top cover 2*c* can be smoothly opened or closed, and a foreign body such as a sheet can be prevented from entering between the left and right sub cover front side arms 62 and further entering into the apparatus casing 2 from the gap Sp1.

Further, the sub cover stack surface formation part 51*s* of the sub cover 51 slightly overlaps the upper side of the rear end part of the top cover stack surface formation part 40*s* of the top cover 2*c*, and covers the gap Sp1 from above. Therefore, the sub cover 51 blocks the gap Sp1 so that cooling air Ar (to be described later) does not leak to the outside via the gap Sp1, and maintains cooling efficiency.

Figure 5:
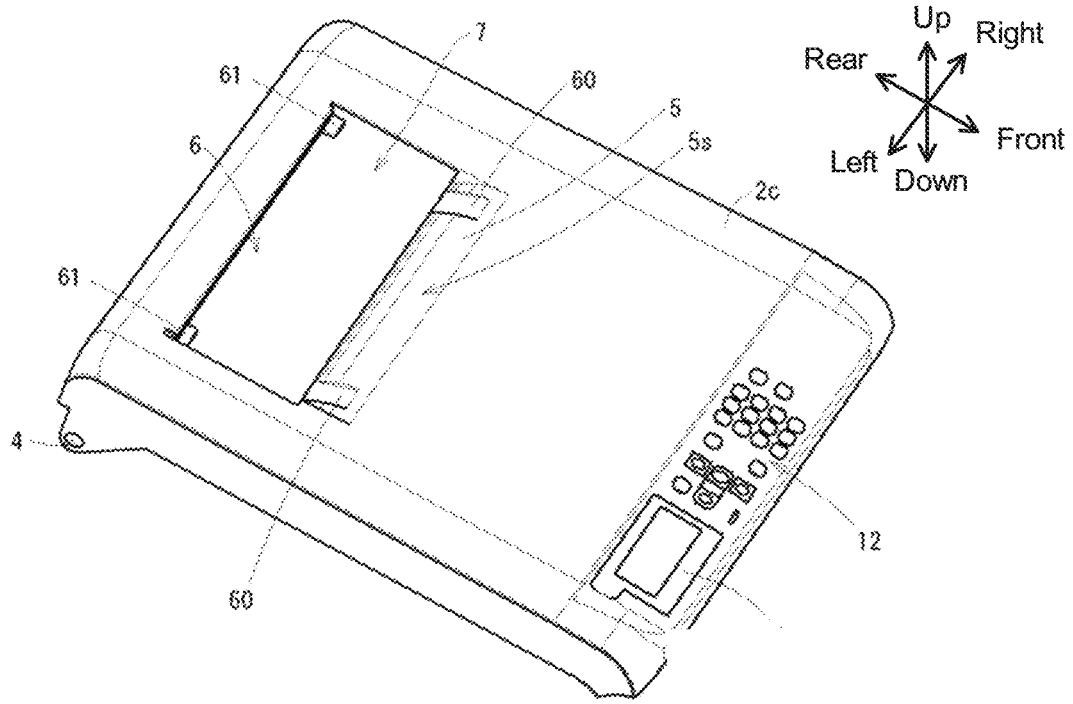
FIG. 5 is a perspective view illustrating the configuration of the top cover in the fuser detached state.
Figure 6:
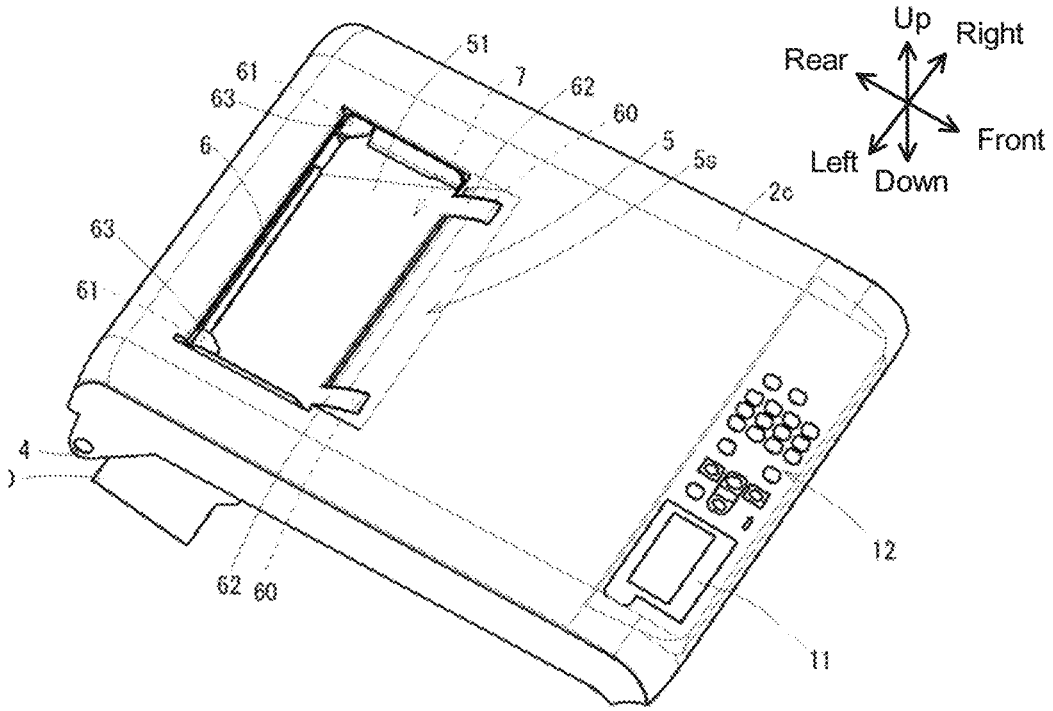
FIG. 6 is a perspective view illustrating the configuration of the top cover in a fuser attached state.
Figure 7:
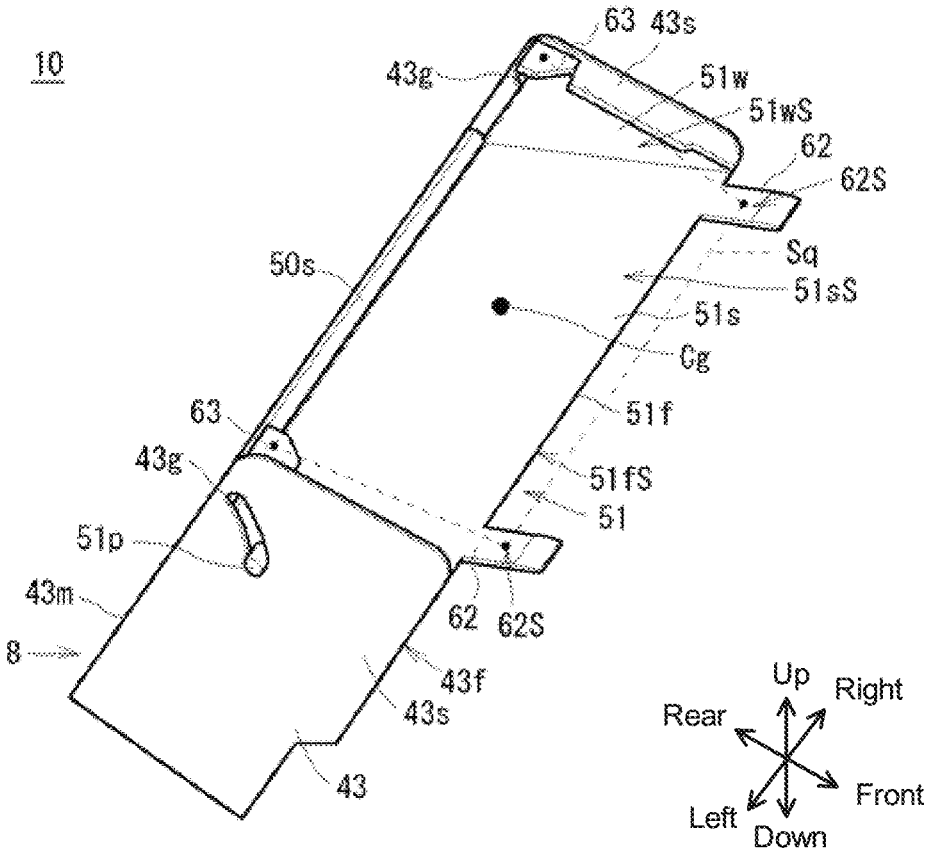
FIG. 7 is a perspective view illustrating the configuration (1) of the fuser unit.
Figure 8:
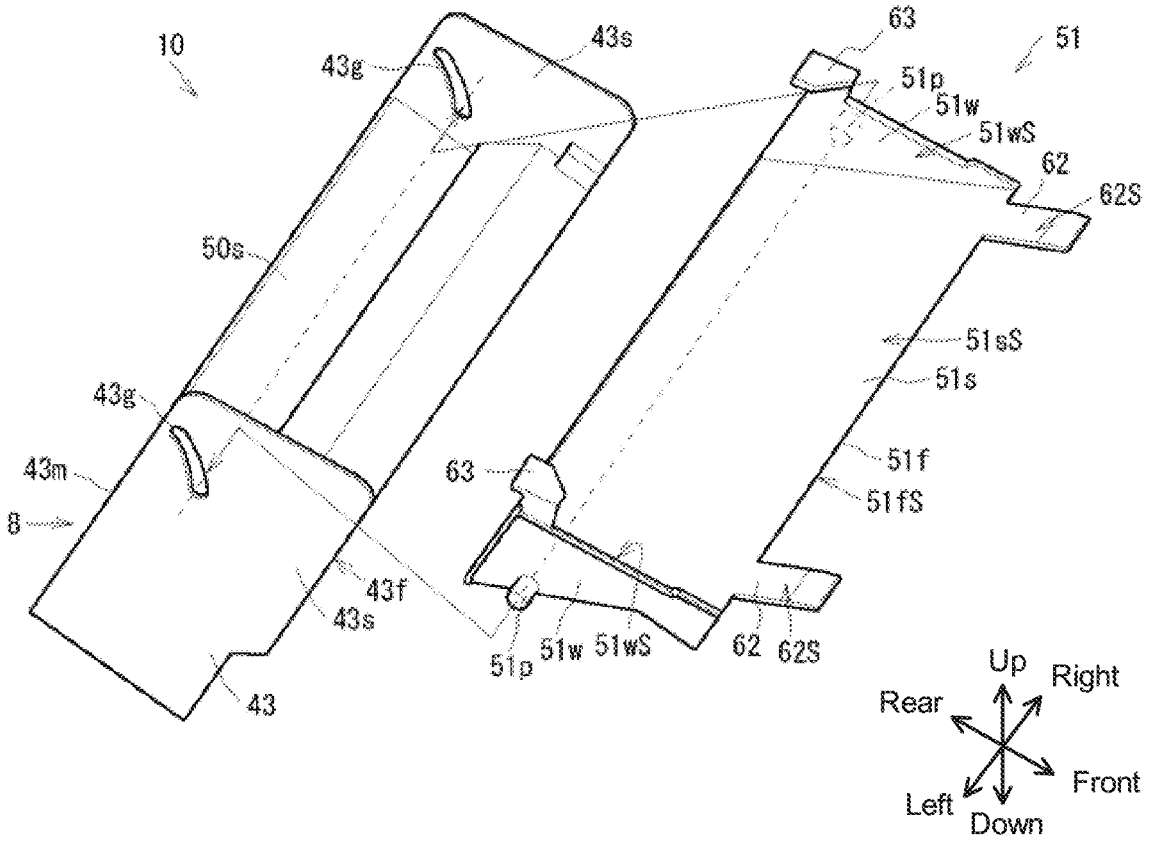
FIG. 8 is a perspective view illustrating the configuration (2) of the fuser unit.

Further, from upper end parts of rear end parts of the sub cover side wall surface formation parts 51*w*, that is, from left and right two sides above the sheet ejection port 6, two sub cover rear side arms 63 as first engaging parts respectively protrude to inner sides in the left-right direction which is the carrying width direction at an interval equal to that of the top cover rear side seats 61 (FIG. 5) in the left-right direction. The sub cover rear side arms 63 each have a substantially trapezoidal plate shape in a plan view. In the fuser attached state (FIGS. 1, 3, 6 and 9), the sub cover rear side arms 63 are respectively placed on the top cover rear side seats 61 in a manner that lower surfaces of the sub cover rear side arms 63 are respectively in contact with the top cover rear side seats 61 (FIG. 5). In this case, the sub cover 51 can be stably placed on the top cover 2*c* by positioning a sub cover gravity center Cg (FIG. 7), which is the gravity center of the sub cover 51, on an inner side of a quadrangle Sq formed by connecting contact points between the top cover rear side seats 61 and the sub cover rear side arms 63 and contact points between the top cover front side seats 60 and the sub cover front side arms 62.

In the fuser attached state, the sub cover rear side arms 63 are provided at a predetermined distance from the top cover rotation center axis 4A, and the sub cover front side arms 62 are provided at a longer distance than the sub cover rear side arms 63 from the top cover rotation center axis 4A.

Further, the cylindrical sub cover posts 51*p* respectively protrude to outer sides in the left-right direction from rear sides near lower end parts of the sub cover side wall surface formation parts 51*w*. The sub cover posts 51*p* as third engaging parts are slidably fitted into the sub cover guide grooves 43*g* of the fuser cover side plates 43*s*. Therefore, the sub cover 51 rotates about the sub cover rotation center axis 51A, that is, about the top cover rotation center axis 4A with respect to the fuser cover 43*m* while the sub cover posts 51*p* slide in the sub cover guide grooves 43*g*.

Figure 11:
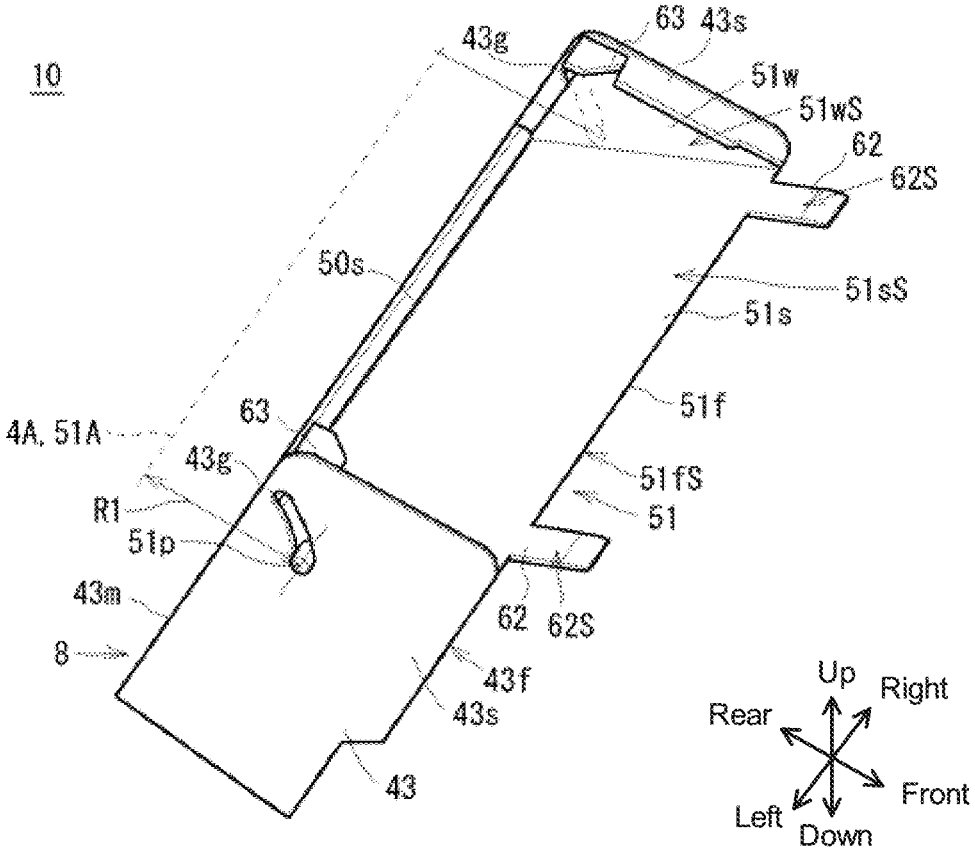
FIG. 11 is a perspective view illustrating the configuration of the fuser unit in the fuser attached state and a sub cover closed state.
Figure 12:
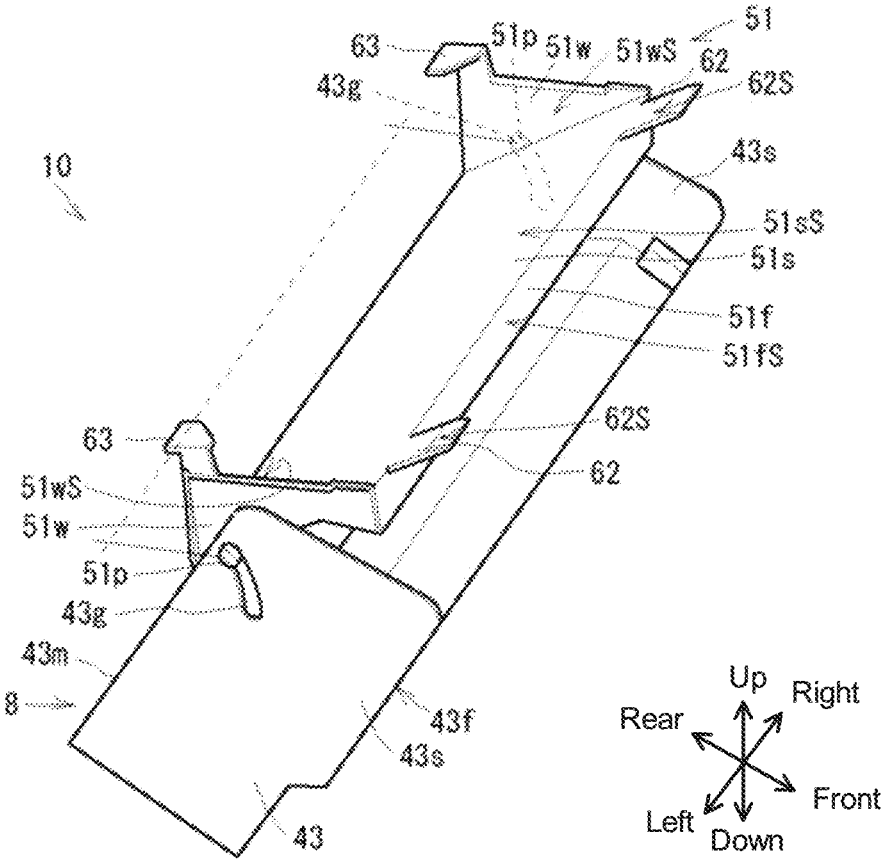
FIG. 12 is a perspective view illustrating the configuration of the fuser unit in the fuser attached state and a sub cover opened state.

As a result, as illustrated in FIGS. 11 and 12, the sub cover 51 opens when the sub cover stack surface formation part 51*s* of the sub cover 51 rotates about the sub cover rotation center axis 51A in a sub cover opening direction which is a counterclockwise direction in FIG. 12 which is a direction away from the fuser cover upper surface 50*s* of the fuser cover 43*m*, and, on the other hand, the sub cover 51 closes when the sub cover stack surface formation part 51*s* of the sub cover 51 rotates in a sub cover closing direction which is a clockwise direction in FIG. 11 which is a direction approaching the fuser cover upper surface 50*s* of the fuser cover 43*m*.

Further, by fitting the sub cover posts 51*p* of the sub cover 51 into the sub cover guide grooves 43*g* of the fuser cover side plates 43*s*, even in the fuser detached state, the sub cover 51 is prevented from being detached from the fuser 8, handling of the fuser unit 10 is facilitated, and the position of the sub cover 51 with respect to the fuser cover 43*m* is regulated.

Here, as a state of the sub cover 51, a state in which, in the top cover closed state (FIGS. 1 and 9), the sub cover posts 51*p* are respectively positioned at lower end parts of the sub cover guide grooves 43*g*, and the sub cover stack surface formation part 51*s* is near the fuser cover upper surface 50*s* of the fuser cover 43*m* is also referred to as a sub cover closed state illustrated in FIG. 11. Further, as a state of the sub cover 51, a state in which, in the top cover opened state (FIGS. 2 and 10), the sub cover posts 51*p* are respectively positioned at upper end parts of the sub cover guide grooves 43*g*, and the sub cover stack surface formation part 51*s* is apart from the fuser cover upper surface 50*s* of the fuser cover 43*m* is also referred to as a sub cover opened state illustrated in FIG. 12.

Further, the sub cover 51 is biased by a torsion spring (not illustrated in the drawings) in the sub cover closing direction in which the sub cover stack surface formation part 51*s* of the sub cover 51 approaches the fuser cover upper surface 50*s* of the fuser cover 43*m*.

In such a configuration, since the sub cover front side arms 62 are in contact with the top cover front side seats 60 and the sub cover rear side arms 63 are in contact with the top cover rear side seats 61, when the top cover 2*c* opens, the sub cover front side arms 62 are lifted upward by the top cover front side seats 60 of the top cover 2*c*, and the sub cover rear side arms 63 are lifted upward by the top cover rear side seats 61, and thus, the sub cover 51 integrally opens together with the top cover 2*c*. Further, when the top cover 2*c* closes, the sub cover 51 closes together with the top cover 2*c* due to the biasing force of the torsion spring (not illustrated in the drawings). In this way, the sub cover 51 covers the gap Sp1 and integrally opens or closes with the top cover 2*c* as the top cover 2*c* opens or closes.

In the sub cover opened state, the sub cover closed state, and all the states of the sub cover 51 during the transition between sub cover opened state and the sub cover closed state, the sub cover front side arms 62 are always in contact with the top cover front side seats 60, and the sub cover rear side arms 63 are always in contact with the top cover rear side seats 61.

8. Take-Out Operation of the Fuser

Next, a take-out operation in which the fuser unit 10 is taken out is described. The take-out operation of the fuser unit 10 is an operation in which the fuser unit 10 is taken out from the image forming apparatus 1 at the time of replacement of the fuser unit 10 due to expiration of its life or when sheet jamming has occurred in the fuser unit 10. While the top cover 2*c* of the image forming apparatus 1 is closed, a user takes out the fuser unit 10 attached to the casing main body part 2*m* from the inside of the casing main body part 2*m* via the fuser insertion port 7 of the top cover 2*c* by grasping the handles (not illustrated in the drawings) exposed from the fuser insertion port 7 of the top cover 2*c* to pull the fuser unit 10 obliquely forward and upward (in the fuser removal direction).

On the other hand, an attaching operation in which the fuser unit 10 is attached to the casing main body part 2*m* is a reverse operation of the take-out operation. That is, the user attaches the fuser unit 10 to the casing main body part 2*m* by pushing the fuser unit 10 down from the fuser insertion port 7 of the top cover 2*c* in the fuser insertion direction D2 into the casing main body part 2*m*.

9. Opening Operation of the Top Cover

Next, an opening operation of the top cover 2*c* is described. The opening operation of the top cover 2*c* is an operation in which the top cover 2*c* is opened when the carrying belt 25 is replaced or when sheet jamming has occurred on an upstream side of the fuser unit 10 in the sheet carrying direction.

First, in the top cover closed state, as illustrated in FIGS. 1, 9 and 11, the sub cover front side arms 62 of the sub cover 51 are in contact, from above, with the top cover front side seats 60 of the top cover 2*c*, and the sub cover rear side arms 63 of the sub cover 51 are in contact, from above, with the top cover rear side seats 61 of the top cover 2*c*. Further, the top cover rotation center axis 4A of the top cover 2*c* and the sub cover rotation center axis 51A of the sub cover 51 are on the same axis.

As illustrated in FIGS. 2, 10 and 12, a user grasps the handle (not illustrated in the drawings) provided on the top cover 2*c* and lifts a front part of the top cover 2*c* upward, and, thereby, the top cover 2*c* rotates about the top cover rotation center axis 4A in the top cover opening direction and opens, and the top cover opened state is achieved. In this case, the sub cover front side arms 62 and the sub cover rear side arms 63 are respectively lifted upward in the top cover opening direction by the top cover 2*c* from the top cover front side seats 60 of the top cover 2*c* and from the top cover rear side seats 61 of the top cover 2*c*, and thereby, the sub cover 51 of the fuser unit 10 opens together with the top cover 2*c*. Further, in this case, with its movement direction regulated by the sliding of the sub cover posts 51*p* in the sub cover guide grooves 43*g* of the fuser cover 43*m*, the sub cover 51 of the fuser unit 10 rotates about the sub cover rotation center axis 51A, that is, the top cover rotation center axis 4A, in the sub cover opening direction on a rotation orbit of the same curvature as the top cover 2*c*. As a result, the sub cover 51 integrally rotates with the top cover 2*c* in the sub cover opening direction while a relative positional relationship in which the sub cover 51 is in contact with the top cover 2*c* is maintained between the sub cover 51 and the top cover 2*c*.

On the other hand, a closing operation in which the top cover 2*c* is closed is a reverse operation of the opening operation. That is, the user closes the top cover 2*c* by pushing the front part of the opened top cover 2*c* downward to rotate the top cover 2*c* in the top cover closing direction. In this case, the sub cover 51 of the fuser unit 10 is lifted by the top cover 2*c* and integrally rotates with the top cover 2*c* in the sub cover closing direction, and closes together with the top cover 2*c* by the biasing force of the torsion spring.

Also in this case, with its movement direction regulated by the sliding of the sub cover posts 51*p* in the sub cover guide grooves 43*g* of the fuser cover 43*m*, the sub cover 51 of the fuser unit 10 rotates about the sub cover rotation center axis 51A, that is, the top cover rotation center axis 4A, in the top cover closing direction on a rotation orbit of the same curvature as the top cover 2*c*. As a result, the sub cover 51 integrally rotates with the top cover 2*c* in the top cover closing direction while a relative positional relationship in which the sub cover 51 is in contact with the top cover 2*c* is maintained between the sub cover 51 and the top cover 2*c*.

10. Effects and the Like

In the image forming apparatus 1 having the above configuration, the fuser insertion port 7 is provided at the rear part of the sheet stacker part 5 provided on the upper surface of the top cover 2*c*, and the fuser unit 10 detachably accommodated in the casing main body part 2*m* can be taken out via the fuser insertion port 7. Therefore, in the image forming apparatus 1, with the top cover 2*c* closed, the fuser unit 10 can be directly taken out from the fuser insertion port 7. As a result, in the image forming apparatus 1, workability in taking out the fuser unit 10 can be improved as compared to a conventional technology can be improved.

Further, in the image forming apparatus 1, in the top cover closed state, the sub cover 51 which is the upper surface of the fuser unit 10 exposed from the fuser insertion port 7 forms the rear part of the sheet stacker part 5. Therefore, in the image forming apparatus 1, for example, the apparatus casing 2 can be downsized as compared to a case where the sheet stacker part 5 and the fuser insertion port 7 are separately provided on the top cover 2*c*.

Here, it is also possible that the top cover 2*c* and the sub cover 51 rotate about different rotation axes. However, in that case, although the top cover 2*c* and the sub cover 51 are interlocked, the relative positional relationship with each other changes as the top cover 2*c* and the sub cover 51 rotate. Therefore, in a state in which sheets are placed on the stack surface 5*s*, when the top cover 2*c* rotates in the top cover opening direction, at a joint between the top cover stack surface formation part 40*s* and the sub cover stack surface 51*s*S in the stack surface 5*s*, a height difference may occur, or a large angular change may occur, and there is a possibility that a sheet may deform in shape or a sheet may fall off from the stack surface 5*s*. Further, in such a case, since the top cover 2*c* and the sub cover 51 separately rotate on mutually different rotation orbits, in order to avoid physical interference between the top cover 2*c* and the sub cover 51 when the top cover 2*c* and the sub cover 51 rotate, it is necessary to design a larger gap Sp1 between the top cover 2*c* and the sub cover 51.

In contrast, in the image forming apparatus 1, the top cover 2*c* is rotated in a state in which the sub cover front side arms 62 of the sub cover 51 are in contact with the upper sides of the top cover front side seats 60, the sub cover rear side arms 63 are in contact with the upper sides of the top cover rear side seats 61, and sub cover 51 is placed on the top cover 2*c*. Therefore, in the image forming apparatus 1, the sub cover 51 can be integrally rotated with the top cover 2*c* while maintaining the relative positional relationship with the top cover 2*c*.

Further, in the image forming apparatus 1, the sub cover posts 51*p* are slid along the sub cover guide grooves 43*g* centered on the sub cover rotation center axis MA which is on the same axis as the top cover rotation center axis 4A of the top cover 2*c*, and the sub cover 51 is rotated about the same axis as the top cover 2*c* Therefore, in the image forming apparatus 1, the sub cover 51 can be stably rotated on a rotation orbit having the same curvature as the top cover 2*c*.

Figure 13:
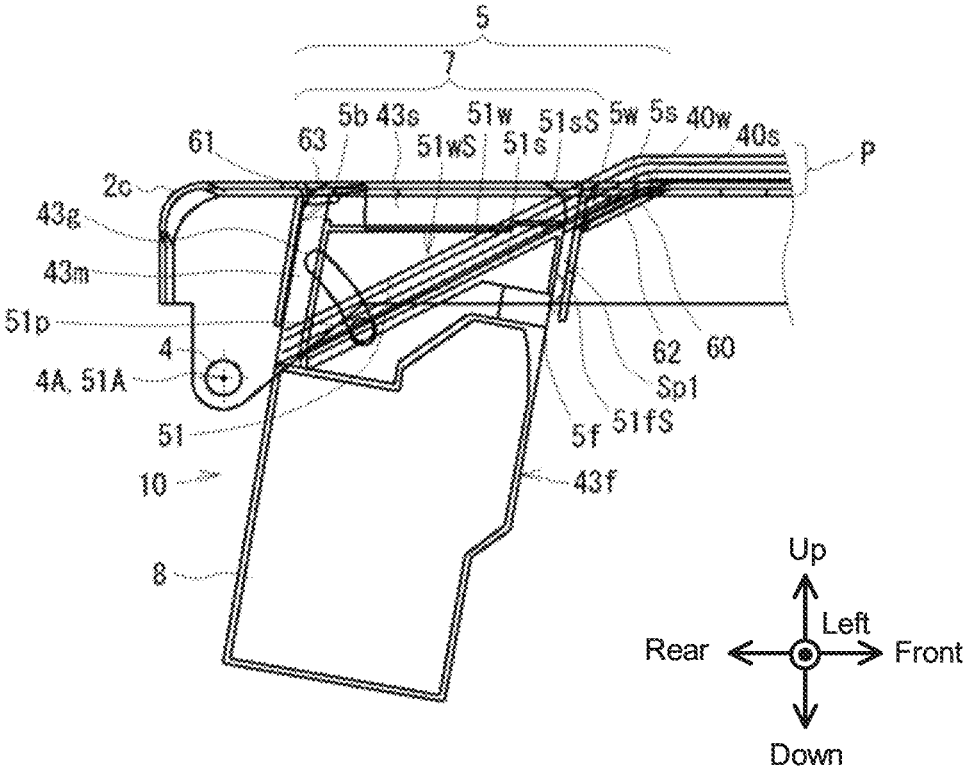
FIG. 13 is a left side view illustrating how sheets are stacked in the top cover closed state.
Figure 14:
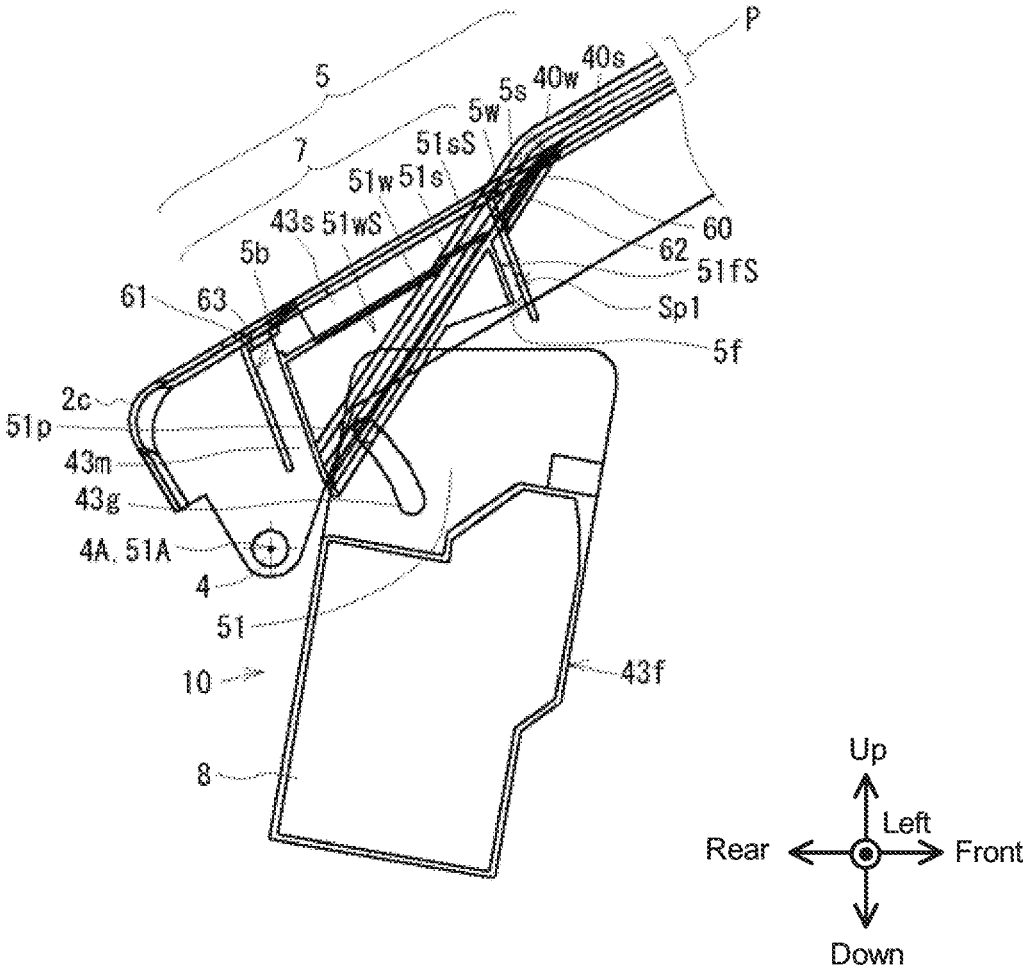
FIG. 14 is a left side view illustrating how sheets are stacked in the top cover opened state.

Therefore, in the image forming apparatus 1, in opening or closing the top cover 2*c*, at the joint between top cover stack surface formation part 40*s* and the sub cover stack surface 51*s*S in the stack surface 5*s*, the top cover stack surface formation part 40*s* and the sub cover stack surface 51*s*S can always be smoothly connected without causing a height difference or a large angular change. As a result, in the image forming apparatus 1, as illustrated in FIGS. 13 and 14, even in the state in which sheets are stacked on the stack surface 5*s*, the top cover 2*c* can be opened or closed while the sheets are stably kept on the stack surface 5*s* without sheet breaking.

Figure 15:
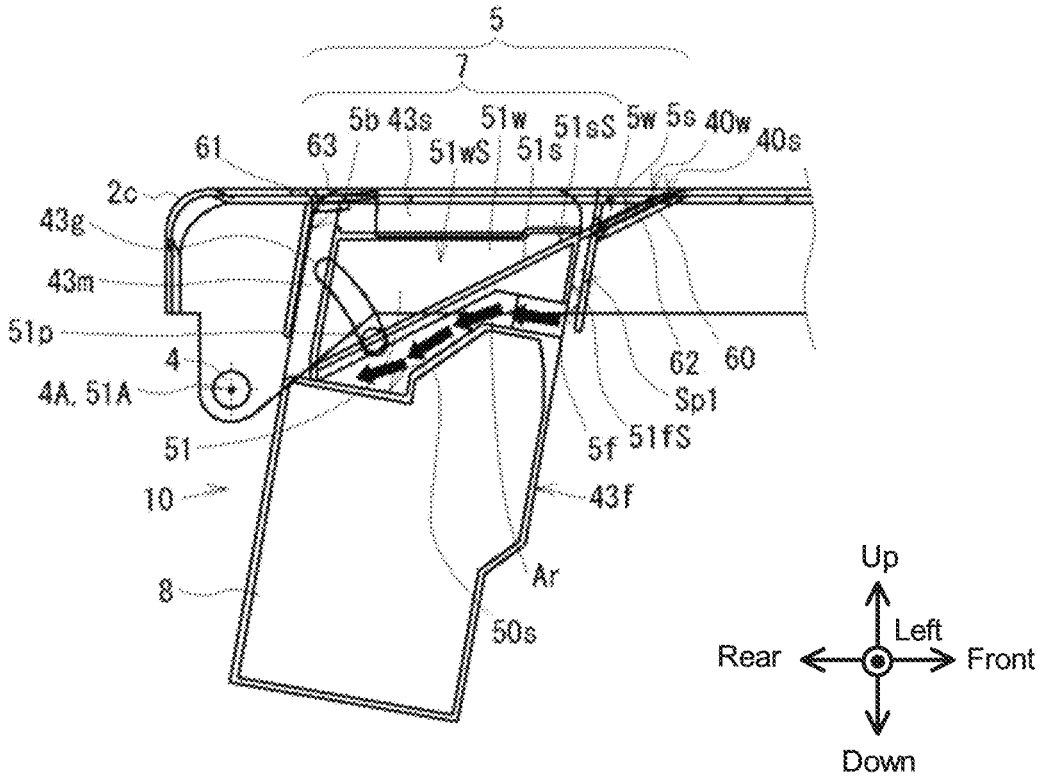
FIG. 15 is a left side view illustrating flow of cooling air.

Further, in the image forming apparatus 1, since the top cover 2*c* and the sub cover 51 are integrally rotated, as compared to a case where the top cover 2*c* and the sub cover 51 are separately rotated on different rotation orbits, a small gap Sp1 between the top cover 2*c* and the sub cover 51 can be designed. Therefore, in the image forming apparatus 1, as illustrated in FIG. 15, inside the apparatus casing 2, cooling air Ar supplied from front toward the fuser unit 10 does not leak to the outside from the gap between the top cover 2*c* and the sub cover 51, and can pass between the fuser cover 43*m* and the sub cover 51 which also serves as the sheet stacker part 5.

Therefore, in the image forming apparatus 1, the sub cover stack surface formation part 51*s* of the sub cover 51, which also serves as the sheet stacker part 5, can be efficiently air-cooled, and cooling efficiency can be improved. As a result, in the image forming apparatus 1, the temperature of the sheet stacker part 5, which is arranged near the upper side of the fuser unit 10 where the temperature is high, can be prevented from becoming high, a sheet after printing can be prevented from becoming curled, and toner on a surface of a sheet can be prevented from re-melting and sticking to the stack surface 5*s*.

According to the above configuration, the image forming apparatus 1 includes: the apparatus casing 2; the top cover 2*c* that has the fuser insertion port 7 as an opening part and is provided rotatable in a rotation direction about the top cover rotation center axis 4A as a rotation axis with respect to the apparatus casing 2; the fuser 8 that is provided attachable to and detachable from the apparatus casing 2 via the fuser insertion port 7 and fuses a toner image formed on the sheet P as a medium; and the sub cover 51 that is provided on the fuser 8 and forms a part of an exterior surface of the top cover 2*c*. The sub cover 51 moves in the rotation direction due to the rotation of the top cover 2*c*.

As a result, in the image forming apparatus 1, the fuser 8 can be directly taken out from the apparatus casing 2 via the fuser insertion port 7 of the top cover 2*c* which rotates the sub cover 51.

11. Other Embodiments

In the above-described embodiment, the case is described where two sub cover front side arms 62 protrude from the front end part of the sub cover stack surface formation part 51*s*. The present invention is not limited to this. Any number of sub cover front side arms 62 may be provided such as that a total of three sub cover front side arms 62 are provided by further providing one sub cover front side arm 62 protruding from a carrying width direction center part at the front end part of the sub cover stack surface formation part 51*s*, or that only one sub cover front side arm 62 protruding from the carrying width direction center part is provided. Further, a sub cover front side arm 62 having a wide width extending from one end side to the other end side in the carrying width direction at the front end part of the sub cover stack surface formation part 51*s* may be formed. Further, it is also possible that the sub cover front side arms 62 are omitted, and the front end part of the sub cover stack surface formation part 51*s* overlaps with the rear end part of the top cover stack surface formation part 40*s*.

Further, in the above-described embodiment, the case is described where the sub cover guide grooves 43*g* are respectively formed at the upper side rear parts of the fuser cover side plates 43*s*. The present invention is not limited to this. The sub cover guide grooves 43*g* may be formed at various other places as long as the sub cover guide grooves 43*g* each have an arc shape that has the same curvature as the rotation path of the top cover 2*c* about the sub cover rotation center axis 51A.

Further, in the above-described embodiment, the case is described where the sub cover posts 51*p* are provided on the sub cover 51, and the sub cover guide grooves 43*g* are provided on the fuser cover 43*m*. The present invention is not limited to this. It is also possible that the arrangement of the posts and the grooves is reversed, and the sub cover posts are provided on the fuser cover 43*m*, and the sub cover guide grooves are provided on the sub cover 51.

Further, in the above-described embodiment, the case is described where the sub cover posts 51*p* of the sub cover 51 are respectively fitted in the sub cover guide grooves 43*g* of the fuser cover 43*m*. The present invention is not limited to this. As long as the sub cover 51 can be prevented from coming off the fuser cover 43*m* and the movement of the sub cover 51 with respect to the fuser cover 43*m* can be regulated, the sub cover guide grooves 43*g* and the sub cover posts 51*p* may have other configurations, or the sub cover guide grooves 43*g* and the sub cover posts 51*p* may be omitted.

Further, when the present invention is applied to an image forming apparatus in which the upper surface of the fuser unit 10 has a position and a size different from those in the above-described embodiment, the position and size of the fuser insertion port 7 may be appropriately modified.

Further, in the above-described embodiment, the case is described where the present invention is applied to the image forming apparatus 1 which is an electrophotographic printer. Without being limited to this, the present invention may also be applied to an image forming apparatus having a configuration different from the image forming apparatus 1 as long as the image forming apparatus is an electrophotographic image forming apparatus. For example, the present invention may also be applied to an image forming apparatus having a configuration in which a toner image formed by an image forming unit is transferred an intermediate transfer belt, and then, to a medium. Further, the present invention may also be applied to a monochromatic image forming apparatus having one image forming unit, or a color image forming apparatus having five or more image forming units. Further, the present invention may also be applied to an image forming apparatus in which an image is formed on a medium other than a sheet of paper. Further, the present invention may also be applied to image forming apparatuses such as an electrophotographic copying machine, a facsimile machine, and a multifunction machine.

Further, in the above-described embodiments, the image forming units 20 as specific examples of image forming parts that form an image on a medium are provided in the image forming apparatus 1. However, without being limited to this, image forming parts having configurations different from the image forming units 20 may be provided in the image forming apparatus 1.

Further, the present invention is not limited to the above-described embodiments and other embodiments. That is, the application scope of the present invention also covers embodiments obtained by arbitrarily combining some or all of the above-described embodiments and the above-described other embodiments, and embodiments obtained by extracting some of the above-described embodiments and other embodiments.

Further, in the above-described embodiment, the case is described where the image forming apparatus 1 as an image forming apparatus is configured by the apparatus casing 2 as an apparatus main body, the top cover 2*c* as a cover member, the fuser 8 as a fuser, and the sub cover 51 as a sub cover member. The present invention is not limited to this. An image forming apparatus may be configured by an apparatus main body, a cover member, a fuser, and sub cover member, which have various other configurations.

In this application, an upper surface of the image forming apparatus means one surface on which image formed media are stacked or collected, which are ejected after image forming process is completed. When the image forming apparatus stands up right, the upper surface may face a side way which is parallel to the ground.

The present invention can be widely used in image forming apparatuses such as an electrophotographic printer, a copying machine, a facsimile, and a multifunction machine.

What is claimed is:

1. An image forming apparatus, comprising:

an apparatus main body;

a cover member that is provided rotatable in a rotation direction about a rotation axis with respect to the apparatus main body, having an opening part, a fuser that fuses a toner image formed on each medium of media wherein the fuser is attached to the apparatus main body by being inserted through the opening part and detached from the apparatus main body by being pulled out of the opening part; and a sub cover member that has an surface portion and is attached to the fuser, wherein in a state in which the fuser is attached to the image forming apparatus, the surface portion of the sub cover is arranged within the opening part, the sub cover member moves in the rotation direction in correspondence with the rotation of the cover member, wherein the rotation axis of the cover member is arranged parallel to a width direction of the media such that the cover member rotates around the rotation axis, the sub cover member has a center axis around which the sub cover member rotates, and the center axis of the sub cover member is coaxial to the rotation axis of the cover member such that the sub cover member rotates together with the rotation of the cover member around the rotation axis.

2. The image forming apparatus according to claim 1, wherein the cover member and the sub cover member are placed on an upper surface of the apparatus main body, each of the media on which the toner image has been fixed by the fuser comes out through the opening part, reaching the continuous surface such that the media are stacked on the continuous surface in a vertical direction.

3. The image forming apparatus according to claim 1, wherein the sub cover member has a first engaging part that is provided at a position at a predetermined distance from the rotation axis and engages with the cover member, and a second engaging part that is provided at a farther distance than the first engaging part from the rotation axis and engages with the cover member, and the sub cover member moves in a state in which the first engaging part and the second engaging part are engaged with the cover member.

4. The image forming apparatus according to claim 3, wherein when the cover member opens by rotating in the rotation direction, the second engaging part is pushed up by the cover member, and thereby, the sub cover member is rotated by the cover member.

5. The image forming apparatus according to claim 1, wherein the sub cover member has an engaging part that engages with the fuser, the fuser has a guide part that engages with the engaging part and guides the sub cover member to move in the rotation direction, and the sub cover member can be moved in the rotation direction by the cover member while the engaging part is guided by the guide part provided on the fuser.

6. The image forming apparatus according to claim 5, wherein the guide part is a long hole formed in an arc shape, and the engaging part is a protruding part inserted into the long hole.

7. The image forming apparatus according to claim 1, wherein the sub cover member has a sub cover stack surface that forms a portion of the exterior surface of the cover member and is for stacking the media.

8. The image forming apparatus according to claim 7, wherein the sub cover member has the sub cover stack surface on an exposed portion, which is exposed from the opening part when the fuser is attached to the apparatus main body, the cover member has a cover stack surface for stacking the media on an outer peripheral part, and when the fuser is attached to the apparatus main body, a stack surface on which the media are stacked is formed by connecting the sub cover stack surface and the cover stack surface.

9. The image forming apparatus according to claim 8, wherein the sub cover member covers a gap (Sp1) provided between the sub cover stack surface and the cover stack surface.

10. The image forming apparatus according to claim 9, wherein the rotation axis around which the cover member and the sub cover member open or close by rotating is positioned on an opposite side with respect to the gap at the exposed portion of the sub cover member.

11. The image forming apparatus according to claim 1, wherein the cover member includes a shaft that forms the rotation axis of the cover member, and the center axis of the sub cover member is an imaginary axis that coincides the rotation axis of the cover member.

12. An image forming apparatus comprising:

an apparatus main body;

a cover member that is provided rotatable in a rotation direction about a rotation axis with respect to the apparatus main body, having an opening part, a fuser that fuses a toner image formed on each medium of media wherein the fuser is attached to the apparatus main body by being inserted through the opening part and detached from the apparatus main body by being pulled out of the opening part; and a sub cover member that has an surface portion and is attached to the fuser, wherein in a state in which the fuser is attached to the image forming apparatus, the surface portion of the sub cover is arranged within the opening part, the sub cover member moves in the rotation direction in correspondence with the rotation of the cover member, wherein the sub cover member has a first engaging part that is provided at a position at a predetermined distance from the rotation axis and engages with the cover member, and a second engaging part that is provided at a farther distance than the first engaging part from the rotation axis and engages with the cover member, and the sub cover member moves in a state in which the first engaging part and the second engaging part are engaged with the cover member.

13. The image forming apparatus according to claim 12, wherein when the cover member opens by rotating in the rotation direction, the second engaging part is pushed up by the cover member, and thereby, the sub cover member is rotated by the cover member.

14. The image forming apparatus according to claim 12, wherein the sub cover member has a third engaging part that engages with the fuser, the fuser has a guide part that engages with the third engaging part and guides the sub cover member to move in the rotation direction, and the sub cover member can be moved in the rotation direction by the cover member while the third engaging part is guided by the guide part provided on the fuser.

15. The image forming apparatus according to claim 14, wherein the guide part is a long hole formed in an arc shape, and the third engaging part is a protruding part inserted into the long hole.

16. The image forming apparatus according to claim 12, wherein the sub cover member has a sub cover stack surface that forms a portion of the exterior surface of the cover member and is for stacking the media.

17. An image forming apparatus comprising:

an apparatus main body;

a cover member that is provided rotatable in a rotation direction about a rotation axis with respect to the apparatus main body, having an opening part, a fuser that fuses a toner image formed on each medium of media wherein the fuser is attached to the apparatus main body by being inserted through the opening part and detached from the apparatus main body by being pulled out of the opening part; and a sub cover member that has an surface portion and is attached to the fuser, wherein in a state in which the fuser is attached to the image forming apparatus, the surface portion of the sub cover is arranged within the opening part, the sub cover member moves in the rotation direction in correspondence with the rotation of the cover member, wherein the sub cover member has an engaging part that engages with the fuser, the fuser has a guide part that engages with the engaging part and guides the sub cover member to move in the rotation direction, and the sub cover member can be moved in the rotation direction by the cover member while the engaging part is guided by the guide part provided on the fuser.

* * * * *